US006106415A

United States Patent [19]

Masutani et al.

[11] Patent Number: 6,106,415

[45] Date of Patent: Aug. 22, 2000

[54] MULTI-LAYER STRUCTURE SOLID GOLF BALL

[75] Inventors: Yutaka Masutani; Keisuke Ihara; Hirotaka Shimosaka; Michio Inoue; Atuki Kasasima; Yasushi Ichikawa, all of Chichibu, Japan

[73] Assignee: Bridgestone Sports Co., Ltd., Tokyo, Japan

[21] Appl. No.: 08/958,191

[22] Filed: Oct. 27, 1997

[30] Foreign Application Priority Data

Oct. 28, 1996 [JP] Japan ..... 8-302474
Jul. 30, 1997 [JP] Japan ..... 9-219285

[51] Int. Cl.[7] ..... A63B 37/06

[52] U.S. Cl. ..... 473/374; 473/373; 473/376

[58] Field of Search ..... 473/373, 374, 473/376

[56] References Cited

U.S. PATENT DOCUMENTS

| | | | |
|---|---|---|---|
| 4,650,193 | 3/1987 | Molitor et al. | 473/373 |
| 4,679,794 | 7/1987 | Yamada et al. | 473/373 |
| 5,609,535 | 3/1997 | Morgan | 473/374 X |
| 5,688,191 | 11/1997 | Cavallaro et al. | 473/374 X |
| 5,725,442 | 3/1998 | Higuchi et al. | 473/373 X |

*Primary Examiner*—Benjamin H. Layno
*Attorney, Agent, or Firm*—Sughrue, Mion, Zinn, Macpeak & Seas, PLLC

[57] ABSTRACT

A multi-layer structure solid golf ball is composed of a solid core (2), an intermediate layer (3), and a cover (4). An adhesive layer (5) is interposed between the intermediate layer (3) and the cover (4). The intermediate layer may be formed from an ionomer or a urethane resin, or a polyester resin. The cover may be formed of an ionomer or a polyester elastomer or a urethane resin. The adhesive is selected from the group consisting of epoxy resin adhesives, urethane resin adhesives, vinyl resin adhesives and rubber adhesives.

7 Claims, 1 Drawing Sheet

MULTI-LAYER STRUCTURE SOLID GOLF BALL

BACKGROUND OF THE INVENTION

1. Field of the Invention

This invention relates to a multi-layer structure solid golf ball comprising a solid core, an intermediate layer, and a cover, featuring improved restitution and spin.

2. Prior Art

Golf balls are generally classified into wound golf balls and solid golf balls. It is generally believed that the wound golf balls are excellent in spin, controllability and hitting feel, but inferior in flight distance to the solid golf balls. Inversely, the solid golf balls travel a long distance, but are inferior in spin and feeling.

In the past, two-piece solid golf balls accounted for the majority of solid golf balls. Nowadays, multi-layer structure solid golf balls as typified by three-piece solid golf balls consisting of a solid core, an intermediate layer, and a cover are increasing. Several improvements are made in these multi-layer structure solid golf balls. By properly selecting the material and thickness of the intermediate layer and the cover or by modifying the intermediate layer and/or the cover to be a multi-layer structure, the spin and feeling which are considered to be drawbacks of solid golf balls are improved while the excellent flight distance characteristic of solid golf balls is maintained or further improved. The controllability and hitting feel comparable to those of wound golf balls are reached. This is the reason why more professional golfers and low-handicap amateur golfers choose solid golf balls.

For these multi-layer structure solid golf balls, however, it is desired to further increase the restitution of the ball so as to travel a longer distance and to further improve the spin properties.

SUMMARY OF THE INVENTION

Therefore, an object of the present invention is to provide a multi-layer structure solid golf ball having improved restitution and spin properties.

The present invention provides a multi-layer structure solid golf ball comprising a solid core, an intermediate layer on the core, and a cover on the intermediate layer. An adhesive layer is interposed between the intermediate layer and the cover.

In the prior art, a multi-layer structure solid golf ball comprising a solid core, an intermediate layer, and a cover is manufactured by forming the intermediate layer around the solid core, mechanically roughening the surface of the intermediate layer as by polishing, and forming the cover on the intermediate layer. The bond between the intermediate layer and the cover largely depends on the anchoring effect of the rough surface of the intermediate layer. With this bonding means, the bond between the intermediate layer and the cover is insufficient. There occur losses of restitution and spin at the interface.

We have found that such losses of restitution and spin at the interface can be avoided by interleaving an adhesive layer between the intermediate layer and the cover whereby the intermediate layer and the cover are bonded through the adhesive layer. The interfacial bond between the intermediate layer and the cover is enhanced whereby the ball is improved in rebound and spin properties.

DETAILED DESCRIPTION OF THE INVENTION

Figure 1:
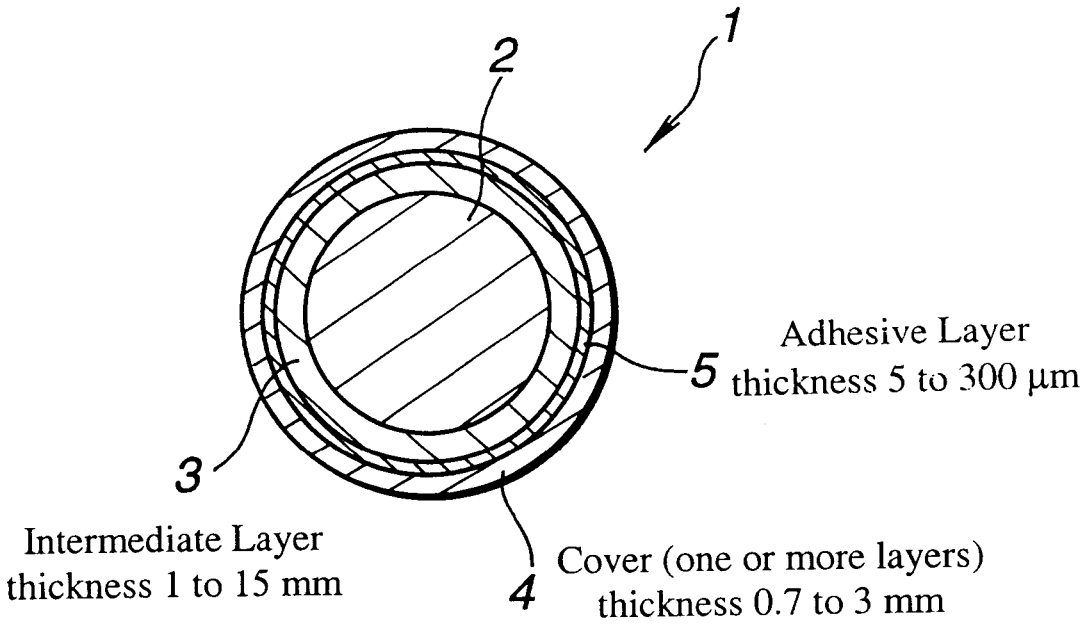
FIG. 1 is a schematic cross-sectional view of a solid golf ball according to one embodiment of the invention.

Referring to FIG. 1, a multi-layer structure solid golf ball 1 according to the invention is illustrated as comprising a solid core 2, an intermediate layer 3 surrounding the core, and a cover 4 surrounding the intermediate layer in a concentric layer arrangement. An adhesive layer 5 is interposed between the intermediate layer 3 and the cover 4. Then the intermediate layer 3 and the cover 4 are joined through the adhesive layer 5.

The intermediate layer and the cover may be formed of well-known materials. Typically, the intermediate layer is formed of ionomer resins, urethane resins, and polyester elastomers, and the cover is formed of ionomer resins and urethane resins. The intermediate layer and the cover are usually formed of different materials. Even when these layers are formed of ionomer resins, ionomer resins having different physical properties (typically hardness) are selected. Of the intermediate layer and the cover, one (e.g., intermediate layer) is formed of an ionomer resin and the other (e.g., cover) formed of a urethane resin in one preferred embodiment of the invention; one is formed of a polyester elastomer and the other formed of an ionomer resin in another preferred embodiment; and one is formed of a polyester elastomer and the other formed of a urethane resin in a further preferred embodiment.

The radial thickness or gage of the intermediate layer and the cover may be properly selected. Usually the intermediate layer has a gage of 1 to 15 mm, especially 1.5 to 5 mm and the cover has a gage of 0.7 to 3 mm, especially 1 to 2 mm. The intermediate layer and the cover each are generally formed as a single layer although the intermediate layer and/or the cover may be constructed of two or more sublayers.

No particular limit is imposed on the adhesive for providing a bond between the intermediate layer and the cover insofar as the adhesive can firmly join them. A choice is made of epoxy resin adhesives, urethane resin adhesives, vinyl resin adhesives, and rubber adhesives.

Prior to the application of the adhesive to the intermediate layer, the surface of the intermediate layer may be roughened by conventional techniques. The gage of the adhesive layer may be properly determined although a gage of 5 to 300 $\mu$m, especially 10 to 100 $\mu$m is preferred.

In the above-mentioned embodiment wherein the intermediate layer and/or the cover is constructed of two or more sublayers, such sublayers may be joined with a similar adhesive.

The solid core may have a well-known composition based on a conventional rubber material such as polybutadiene rubber. The composition and physical properties of the solid core may be similar to conventional solid cores. Often, the solid core experiences a distortion of 1.0 to 10.0 mm under a load of 100 kg and is formed of a rubber base composition. The size of the solid core is also as usual.

If desired, the solid core and the intermediate layer may be joined with an adhesive as mentioned above. The solid core may be of a single layer construction or a multi-layer construction.

The golf ball of the invention is manufactured by applying the adhesive to the surface of the intermediate layer and placing the cover thereon while the remaining steps may be done as conventional. The size and weight of the ball are in accord with the Rules of Golf.

EXAMPLE

Examples of the invention are given below by way of illustration and not by way of limitation.

Examples 1–2 & Comparative Examples 1–2

Solid cores were prepared by mixing the components shown in Table 1 and molding the mix under pressure in a conventional manner. An ionomer resin mixture consisting of Himilan 1706 and Himilan 1605 in a weight ratio of 1/1 was injection molded on the solid core to form an intermediate layer. The surface of the intermediate layer was mechanically roughened. An adhesive was applied to the surface of the intermediate layer by a dispersion coating technique. A urethane resin (Pandex T7890 by Dai-Nihon Ink Chemical Industry K.K.) was injection molded on the adhesive-coated intermediate layer. In this way, there were manufactured three-piece golf balls of the structure shown in FIG. 1 and having properties as reported in Table 2.

The adhesive used was a two-part curable aqueous urethane adhesive composition consisting of an aqueous dispersion of an amine terminated type carboxyl group-bearing polymer as a base and a polycarbodiimide crosslinking agent as a curing agent. The base and the curing agent were mixed in a weight ratio of 100:5. The urethane resin was injection molded after the adhesive was dried.

For comparison purposes, three-piece golf balls of Comparative Examples 1 and 2 were manufactured as above except that no adhesive layer was formed.

The golf balls were examined for flight performance and hitting durability by the following tests. The results are shown in Table 2.

Flight Performance

Using a swing robot by True Temper Co., the ball was hit with a driver (W#1) at a head speed of 50 m/s (HS50). The carry and total distance were measured.

Using the same robot, the ball was hit with a sand wedge (SW) at a head speed of 20 m/s (HS20). The spin of the ball was observed using a Science Eye stroboscope (by Bridgestone Co., Ltd.).

Durability Test

Using a swing robot by True Temper Co., the ball was hit 300 times with a driver at a head speed of 38 m/s. The number of shots was counted until the ball was broken.

TABLE 1

| | Composition (pbw) | Example 1 | Example 2 | Comparative Example 1 | Comparative Example 2 |
|---|---|---|---|---|---|
| Solid core | High 1,4-cis-polybutadiene | 100 | 100 | 100 | 100 |
| | Zinc diacrylate | 30.5 | 33 | 30.5 | 33 |
| | Zinc oxide | 5 | 5 | 5 | 5 |
| | Barium sulfate | 9 | 7.9 | 9 | 7.9 |
| | Antioxidant | 0.2 | 0.2 | 0.2 | 0.2 |
| | Zinc salt of pentachlorothiophenol | 1 | 1 | 1 | 1 |
| | Dicumyl peroxide | 0.8 | 0.8 | 0.8 | 0.8 |
| Intermediate layer | Himilan 1706*1 | 50 | 50 | 50 | 50 |
| | Himilan 1605*1 | 50 | 50 | 50 | 50 |
| Adhesive layer | Two-part curable aqueous urethane adhesive | X | X | — | — |
| Cover | Urethane resin | X | X | X | X |

*1Himilan 1706 and 1605 are ionomer resins available from Mitsui duPont Polychemical K.K.
Himilan 1706: ethylene-methacrylic acid copolymer ionomer, acid content ~15 wt %, ion species Zn, degree of ionization ~60 mol %
Himilan 1605: ethylene-methacrylic acid copolymer ionomer, acid content ~15 wt %, ion species Na, degree of ionization ~30 mol %

TABLE 2

| | | Example 1 | Example 2 | Comparative Example 1 | Comparative Example 2 |
|---|---|---|---|---|---|
| Solid core | Diameter (mm) | 36.54 | 36.51 | 36.54 | 36.51 |
| | Specific gravity | 1.131 | 1.137 | 1.131 | 1.137 |
| | Weight (g) | 28.9 | 29.0 | 28.9 | 29.0 |
| | Hardness*2 (mm) | 3.8 | 3.1 | 3.8 | 3.1 |
| | Initial velocity (m/s) | 79.37 | 78.7 | 78.3 | 78.7 |
| Intermediate layer | Diameter (mm) | 39.7 | 39.7 | 39.7 | 39.7 |
| | Gage (mm) | 1.58 | 1.60 | 1.58 | 1.60 |
| | Weight*3 (g) | 36.0 | 36.1 | 36.3 | 36.4 |
| | Hardness*2 (mm) | 3.2 | 2.7 | 2.3 | 1.8 |
| | Initial velocity (m/s) | 77.9 | 78.0 | 78.1 | 78.2 |
| Adhesive layer | Gage (μm) | 50 | 50 | — | — |
| Cover | Gage (mm) | 1.6 | 1.6 | 1.6 | 1.6 |
| | Hardness (Shore D) | 38 | 38 | 38 | 38 |
| Golf ball | Diameter (mm) | 42.8 | 42.8 | 42.8 | 42.8 |
| | Hardness*2 (mm) | 2.8 | 2.4 | 2.8 | 2.4 |
| | Weight (g) | 45.2 | 45.4 | 45.6 | 45.8 |
| Durability over 300 shots | | intact | intact | broken at 50 shots | broken at 50 shots |
| W#1/HS50 | Initial velocity (m/s) | 76.8 | 77.0 | 76.2 | 76.4 |
| | Spin (rpm) | 2630 | 2850 | 2610 | 2860 |
| | Launch angle (°) | 9.1 | 9.2 | 9.1 | 9.2 |
| | Elevation angle (°) | 11.5 | 11.7 | 11.5 | 11.7 |
| | Carry (m) | 230.5 | 232.8 | 228.0 | 230.2 |
| | Total (m) | 248.6 | 251.1 | 246.0 | 249.0 |
| SW/HS20 | Spin (rpm) | 5810 | 6030 | 5210 | 5450 |
| | Launch angle (°) | 26.6 | 26.2 | 27.4 | 26.9 |

*2a distortion under a load of 100 kg. The hardness of the intermediate layer is a distortion of the solid core enclosed with the intermediate layer.
*3the weight of the solid core and the intermediate layer combined Examples 3–6 & Comparative Examples 3–6

Three-piece golf balls were manufactured as in Example 1 except that the solid core, intermediate layer, and cover were of the compositions shown in Table 3 and the adhesive was diluted and spray coated.

The golf balls were similarly examined for flight performance and hitting durability by hitting with a driver at a head speed of 50 m/s (W#1/HS50), with a driver at a head speed of 45 m/s (W#1/HS45), with No. 5 iron at a head speed of 40 m/s (I#5/HS40), and with a sand wedge at a head speed of 25 m/s (SW/HS25).

TABLE 3

| Composition (pbw) | | Example 3 | Example 4 | Example 5 | Example 6 | Comparative Example 3 | Comparative Example 4 | Comparative Example 5 | Comparative Example 6 |
|---|---|---|---|---|---|---|---|---|---|
| Solid core | Polybutadiene*4 | 100 | 100 | 100 | 100 | 100 | 100 | 100 | 100 |
| | Zinc oxide | 30 | 30 | 30 | 30 | 30 | 30 | 30 | 30 |
| | Curing agent (ZAA) | 18 | 18 | 18 | 18 | 18 | 18 | 18 | 18 |
| | Dicumyl peroxide | 1.2 | 1.2 | 1.2 | 1.2 | 1.2 | 1.2 | 1.2 | 1.2 |
| Intermediate layer | Polyester elastomer*5 | X | — | — | X | X | — | — | x |
| | Ionomer resin*6 | — | X | X | — | — | X | X | — |
| Adhesive layer | Urethane resin adhesive*7 | X | — | X | — | — | — | — | — |
| | Vinyl resin adhesive*8 | — | — | — | X | — | — | — | — |
| | Rubber adhesive*9 | — | X | — | — | — | — | — | — |
| Cover | Inomer resin*10 | X | — | — | — | X | — | — | — |
| | Urethane resin*11 | — | X | X | X | — | X | X | X |

*4a mixture of BR01/BR11 in a weight ratio of 50/50, by Nippon Synthetic Rubber K.K.
*5Hytrel H4047 by Mitsui duPont Polychemical K.K.
*6an ionomer resin mixture of Surlyn S8120 (Na ionomer) and Himilan 1855 (Zn ionomer) in a weight ratio of 65/35
*7two-part curable aqueous urethane adhesive used in Example 1
*8trade name 251 by Sunstar K.K.
*9trade name G17 by Konishi Bond K.K.
*10an ionomer resin mixture of Himilan 1706 and Himilan 1605 in weight ratio of 50/50
*11Pandex T7890 by Dai-Nihon Ink Chemical Industry K.K.

TABLE 4

| | | Example 3 | Example 4 | Example 5 | Example 6 | Comparative Example 3 | Comparative Example 4 | Comparative Example 5 | Comparative Example 6 |
|---|---|---|---|---|---|---|---|---|---|
| Solid core | Diameter (mm) | 35.25 | 35.28 | 35.30 | 35.18 | 35.22 | 35.25 | 35.24 | 35.27 |
| | Specific gravity | 1.18 | 1.18 | 1.18 | 1.18 | 1.18 | 1.18 | 1.18 | 1.18 |
| | Weight (g) | 29.2 | 29.0 | 28.9 | 29.2 | 28.9 | 29.1 | 29.0 | 29.1 |
| | Hardness*2 (mm) | 4.1 | 4.1 | 3.9 | 4.0 | 4.0 | 4.0 | 3.8 | 4.1 |
| | Initial velocity (m/s) | 77.10 | 77.00 | 77.12 | 77.03 | 77.05 | 77.08 | 77.12 | 77.00 |
| Intermediate layer | Diameter (mm) | 39.25 | 29.28 | 39.30 | 38.58 | 39.22 | 39.25 | 39.24 | 38.67 |
| | Gage (mm) | 2.0 | 2.0 | 2.0 | 1.7 | 2.0 | 2.0 | 2.0 | 1.7 |
| | Weight*3 (g) | 35.15 | 35.18 | 35.14 | 35.17 | 35.15 | 35.16 | 35.15 | 35.13 |
| | Hardness (Shore D) | 40 | 51 | 51 | 40 | 40 | 51 | 40 | 40 |
| | Initial velocity (m/s) | 76.50 | 77.32 | 77.30 | 76.53 | 76.52 | 77.33 | 77.29 | 76.50 |
| Adhesive layer | Gage ($\mu$m) | 10 | 10 | 10 | 15 | 15 | 15 | 15 | 15 |
| Cover | Gage (mm) | 1.7 | 1.7 | 1.7 | 1.7 | 1.7 | 1.7 | 1.7 | 1.7 |
| | Hardness (Shore D) | 65 | 50 | 50 | 50 | 64 | 50 | 50 | 50 |
| Golf ball | Diameter (mm) | 42.65 | 42.55 | 42.55 | 42.70 | 42.67 | 62.53 | 42.56 | 42.66 |
| | Hardness*2 (mm) | 3.02 | 2.79 | 2.80 | 3.00 | 3.06 | 2.88 | 3.04 | 3.09 |
| | Weight (g) | 45.28 | 45.30 | 45.30 | 45.31 | 45.29 | 45.30 | 45.30 | 45.31 |
| Durability over 300 shots | | intact | intact | intact | intact | broken at 197 shots | broken at 220 shots | deformed at 220 shots | deformed at 220 shots |
| W#1/HS50 | Initial velocity (m/s) | 77.01 | 77.10 | 77.12 | 76.95 | 76.80 | 76.90 | 76.86 | 76.78 |
| | Spin (rpm) | 2435 | 2498 | 2380 | 2283 | 2332 | 2268 | 2288 | |
| | Launch angle (°) | 9.9 | 9.7 | 9.6 | 10.1 | 10 | 9.7 | 9.9 | 10.1 |
| W#1/HS45 | Spin (rpm) | 2290 | 2224 | 2200 | 2132 | 2150 | 2096 | 2125 | 2071 |
| | Launch angle (°) | 9.5 | 9.5 | 9.6 | 9.5 | 9.8 | 9.7 | 9.6 | 9.5 |
| I#5/HS40 | Spin (rpm) | 5113 | 5623 | 5203 | 5179 | 4978 | 5203 | 4988 | 4994 |
| | Launch angle (°) | 12 | 11 | 11.3 | 11.3 | 12.2 | 11.7 | 12.2 | 12.2 |
| SW/HS25 | Spin (rpm) | 4720 | 5089 | 4820 | 4869 | 4358 | 4873 | 4427 | 4471 |
| | Launch angle (°) | 35.3 | 34.7 | 34.9 | 35.5 | 36.2 | 35.6 | 36.2 | 36.1 |

*2a distortion under a load of 100 kg. The hardness of the intermediate layer is a distortion of the solid core enclosed with the intermediate layer.
*3the weight of the solid core and the intermediate layer combined It is evident from Tables 2 and 4 that the solid golf balls within the scope of the invention show an increased initial velocity, high restitution and an increased flight distance upon hitting and improved spin properties upon iron shots. It is also evident that the solid golf balls within the scope of the invention are fully durable against repetitive shots.

There has been described a multi-layer structure solid golf ball wherein the intermediate layer and the cover are joined by an adhesive layer whereby the ball is improved in resilience and spin properties.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A multi-layer structure solid golf ball comprising: a solid core, an intermediate layer and a cover, said intermediate layer being formed of a material selected from the group consisting of an ionomer resin, urethane resin and polyester elastomer and having a thickness in the range of 1 to 15 mm, said cover being formed of a material selected from the group consisting of an ionomer resin and urethane resin and having a thickness in the range of 0.7 to 3 mm, wherein said cover is formed of a material different from that of said intermediate layer, and an adhesive layer interposed between said intermediate layer and said cover.

2. The golf ball of claim 1, wherein said adhesive is selected from the group consisting of epoxy resin adhesives, urethane resin adhesives, vinyl resin adhesives and rubber adhesives.

3. The golf ball of claim 1 wherein said adhesive layer has a thickness in the range of 5 to 300 $\mu$m.

4. The golf ball of claim 1 wherein said core has a distortion of 1.0 to 10.0 mm under a load of 100 kg.

5. The golf ball of claim 1 wherein one of the intermediate layers and the cover is formed of an ionomer resin and the other is formed of a urethane resin.

6. The golf ball of claim 5 wherein the intermediate layer is formed of a polyester elastomer and the cover is formed of a urethane resin.

7. The golf ball of claim 1 wherein the intermediate layer is formed of a polyester resin and the cover is formed of an ionomer resin.

* * * * *